US005657768A

United States Patent [19]

Neumann et al.

[11] Patent Number: 5,657,768

[45] Date of Patent: Aug. 19, 1997

[54] CIGARETTE TUBE FILLING DEVICE

[75] Inventors: Manfred Neumann; Josef Lier, both of Radevormwald, Germany

[73] Assignee: Gizeh-Werk GmbH, Bergneustadt, Germany

[21] Appl. No.: 596,368

[22] PCT Filed: Aug. 13, 1994

[86] PCT No.: PCT/DE94/00930

§ 371 Date: Feb. 22, 1996

§ 102(e) Date: Feb. 22, 1996

[87] PCT Pub. No.: WO95/05756

PCT Pub. Date: Mar. 2, 1995

[30] Foreign Application Priority Data

Aug. 24, 1993 [DE] Germany ..... 9312660 U

[51] Int. Cl.[6] ..... A24C 5/00

[52] U.S. Cl. ..... 131/70; 131/72; 131/71; 131/75

[58] Field of Search ..... 131/70, 71, 75

[56] References Cited

U.S. PATENT DOCUMENTS 3,783,882 1/1974 Messner et al. ..... 131/70

3,903,902 9/1975 Messner et al. ..... 131/70

5,398,701 3/1995 Neumann et al. ..... 131/70

FOREIGN PATENT DOCUMENTS 2 150 199 3/1973 France ..... 131/70

2 055 673 5/1972 Germany ..... 131/70

2 159 054 6/1972 Germany ..... 131/70

*Primary Examiner*—V. Millin

*Assistant Examiner*—Charles W. Anderson

*Attorney, Agent, or Firm*—Foley & Lardner

[57] ABSTRACT

The cigarette tube filling device (100) comprises a housing bottom part (1), consisting of a base part (2) and of a cover part (3), as well as a housing top part (6). There is formed a press chamber (8), the lower half of which is formed by a tongue (12) and the upper half (11) of which is formed by a part-cylindrical recess (11) of the top part (6). The housing top part (6) is mounted on the housing bottom part (1) pivotably about an axis (7) extending parallel to the press chamber (8). In the housing bottom part (1), a straight guide (27, 28) parallel to the press chamber (8) is provided for the slide (20) comprising the tongue (12).

7 Claims, 3 Drawing Sheets

FIG. 1
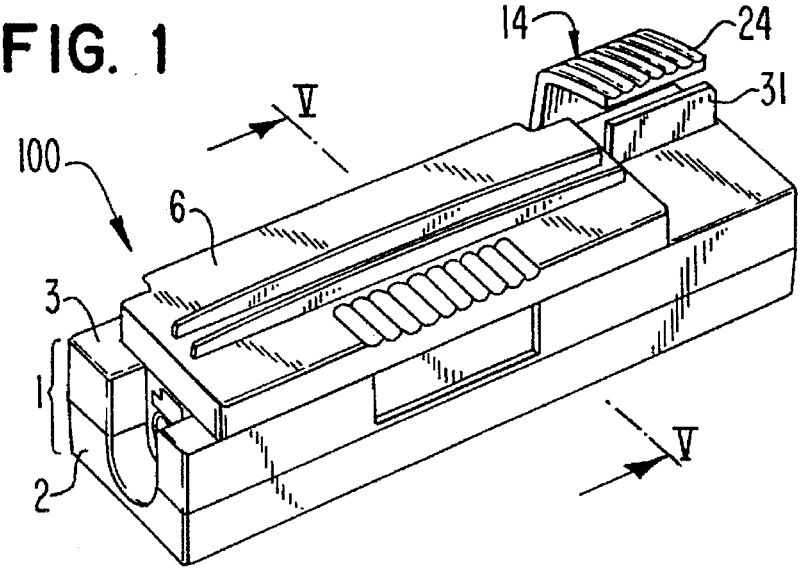
FIG. 2
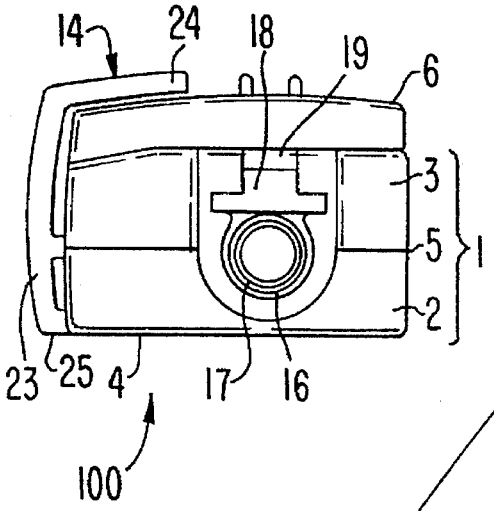
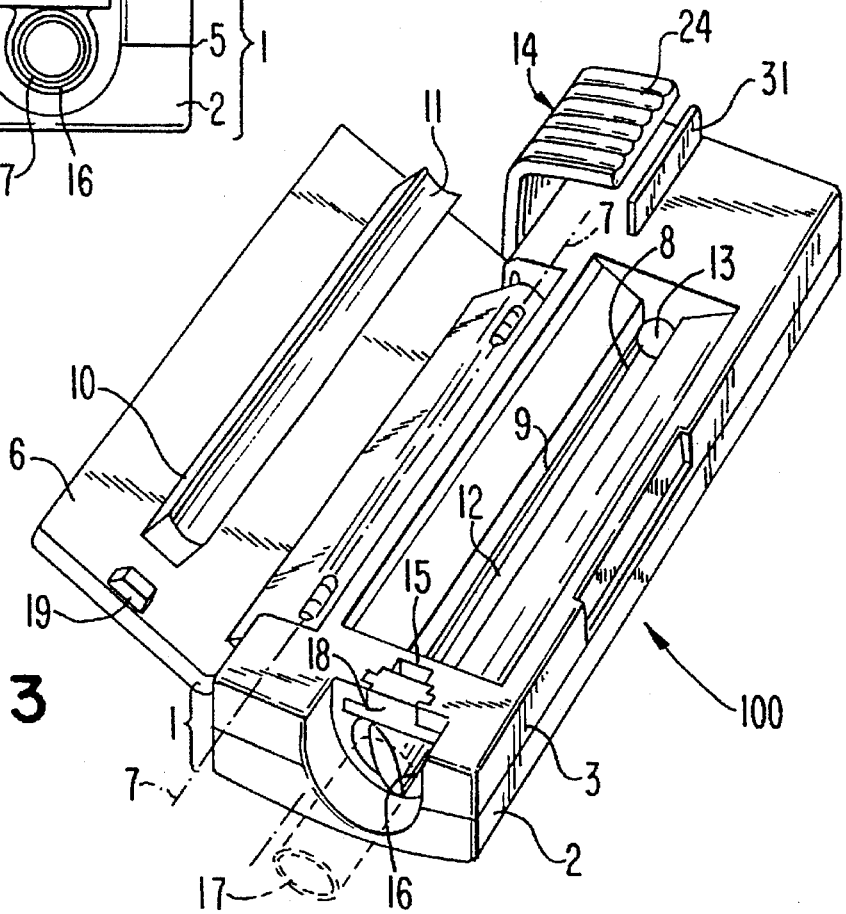
FIG. 3

CIGARETTE TUBE FILLING DEVICE

BACKGROUND OF THE INVENTION

1. Field of the Invention

The invention relates to a cigarette tube filling device with a housing bottom part having an approximately semicylindrical lower half of a press chamber for forming a shaped tobacco article.

2. Description of Related Art

A cigarette tube filling device of this type is disclosed in DE 2,159,054. In this document, the housing bottom part is block-like and on the top side has, for forming a press chamber, an approximately semi-cylindrical recess, on which a thin-walled semicylindrical tongue rests having an end remote from the ejection nozzle provided with an abutment and a pin-shaped extension projecting outward through a slot at the housing bottom part transversely to the axis of the press chamber. In one embodiment, finger engagement takes place directly on a spherical thick portion of the extension, and in another embodiment there is provided a slide which engages over the housing top part pivoted downward onto the housing bottom part and which grasps the end of the extension by means of a perforation and offers a relatively large engagement surface.

In both cases, the guidance of the tongue leaves much to be desired. The propulsive force exerted on the end of the extension on the outside leads to a bending moment which is conducted to the end of the thin-walled tongue. This results in one-sided bearing of the tongue in the semicylindrical recess of the housing bottom part and in considerable friction. The forces, already appreciable in any case, which are necessary for pushing out the formed pressurized tobacco strand into the cigarette tube are further intensified as a result of the friction.

This known embodiment is also complicated to produce, either because the housing bottom part must be openable at the end so that the tongue together with the abutment and the extension can be pushed in from the end, or because a separate extension has to be connected to the tongue and the abutment through the slot from the side.

DE 2,055,673C discloses a similar cigarette tube filling device which, laterally of the actual filling device, also comprises a storage space for tobacco.

In this document, the extension located on the tongue is angled at 90° and extends through a corresponding duct to the side wall, where an actuating knob is provided. At the same time, the tongue, in a self-supporting manner, forms the lower half of the press volume. However, guidance in the angled duct easily leads to tilts and, moreover, makes it necessary for the housing bottom part to be composed of a plurality of parts in the region of this duct.

SUMMARY OF THE INVENTION

An object of the invention is to provide a generic cigarette tube filling machine which works smoothly and is easy to assemble. This object is achieved by means of a cigarette tube filling device comprising:

a housing bottom part including an approximately semicylindrical lower half of a press chamber, said press chamber having a length;

a housing top part including an approximately semicylindrical upper half of said press chamber;

said housing top part having an opened position for allowing receipt of tobacco into said lower half of said press chamber and pivoting to a closed position about a pivot axis parallel to an axis of said press chamber;

a nozzle at one end of said press chamber and concentric to said press chamber, said nozzle having a diameter approximately equal to a diameter of said press chamber;

a device for clamping a cigarette tube on said nozzle when said housing top part is pivoted to said closed position; and a unitary component comprising a flute-shaped tongue extending in said housing bottom part along a substantial part of said length of said press chamber and receiving said tobacco;

a slide at an end of said press chamber opposite said nozzle, forming an abutment for an end of a shaped tobacco article, and being displaceable along said press chamber; and an extension extending through a lateral slot of said housing bottom part and having a handle arranged outside said housing bottom part for displacing said unitary component along said press chamber;

wherein said housing bottom part is subdivided at a separating plane and comprises a trough-shaped base part and a cover part;

a linear guide projection protrudes from one of said base part and said cover part parallel to said press chamber and engages said slide of said unitary component; and when said base part and cover part are separated, said unitary component can be inserted into said housing bottom part transversely to said separating plane.

Another object of the invention is to provide in the above cigarette tube filling device a component consisting of tongue, slide and extension which can be inserted into the base part, whereupon the cover part is attached and assembled together with the base part. This assembly alone at the same time brings into operation the straight guide which ensures exact support against the propulsive forces, without the tongue itself having to perform a guidance function.

Another object is to provide a cigarette tube filling device as above, wherein said guide projection is formed in said base part.

Another object is to provide a cigarette tube filling device as above, wherein said guide projection comprises a guide web projecting upward from said base part and extending parallel to said press chamber; and said slide includes a guide groove, complimentary to said guide web and formed to closely surround said guide web.

Another object is to provide a cigarette tube filling device as above, wherein said device further comprises snap connection means for joining said base part and said cover part.

Another object is to provide a cigarette tube filling device as above, wherein said guide web projects parallel to said press chamber and adjacent said extension.

Another object is to provide a cigarette tube filling device as above, wherein a supporting web extends from said bottom of said base part over a portion of said length of said press chamber and engages an underside of said tongue.

Another object is to provide a cigarette tube filling device as above, wherein said handle extends adjacent said housing over a height of said housing and can be grasped between two fingers.

Another object is to provide a device as above, wherein assembly of the two parts of the housing bottom part should take place by means of a snap connection, so that assembly can be carried out virtually with one manipulation.

For reasons of saving of space, it is preferred to arrange the guide web on the sides of the press chamber which face the extension.

Since the tongue, in a self-supporting manner, forms the lower part of the press chamber, the tongue is exposed to pressure caused by the compression of the tobacco strand when the housing top part is pivoted downward and the tobacco strand is formed. For support against this pressure, a supporting web is provided. Guidance of the handle, that is to say the extension and the slide, is not loaded by the handle grasping forces. Moreover, in this case, the exertion of the propulsive force presents particularly few problems.

BRIEF DESCRIPTION OF THE DRAWINGS

FIG. 1 shows a perspective view of the cigarette tube filling device in the initial state;

FIG. 2 shows a view according to FIG. 1 from the left on an enlarged scale;

FIG. 3 shows a perspective view of the cigarette tube filling device, with the housing top part swung open;

DETAILED DESCRIPTION OF THE INVENTION

Figure 4:
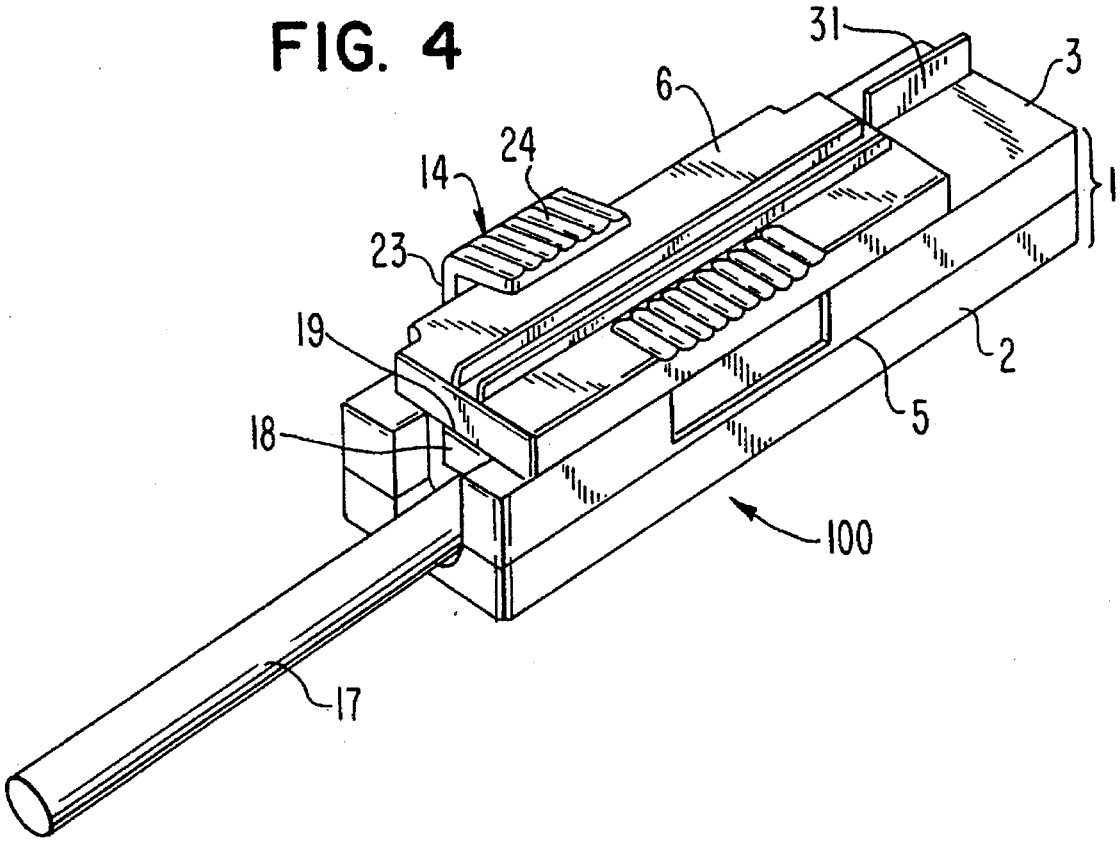
FIG. 4 shows a perspective view of the cigarette tube filling device after the filling of a cigarette tube has taken place.

The cigarette tube filling device, designated as a whole by 100 in FIG. 1, is represented there approximately in its natural size. It has a generally elongately cuboidal outer shape, the longest side of the cuboid extending parallel to the press chamber. The cigarette tube filling device 100 can therefore be carried conveniently in a jacket pocket.

The cigarette tube filling device 100 comprises a housing bottom part 1 which itself consists of a base part 2 and a cover part 3 which are separated along a separating plane 5 approximately parallel to the base surface 4 and which can be connected to one another by means of hook-like snap connections attached at a plurality of locations and not reproduced in the drawings.

In the normal operating position evident in FIGS. 1, 3 and 4, when the cigarette tube filling device is being used, the latter rests with the base surface 4 on a horizontal bed, for example a table. The horizontal projections of the base part 2 and of the cover part 3 of the housing bottom part 1 overlap one another in this case.

In the region of an upper lateral longitudinal edge, the housing top part 6 is mounted foldably or pivotably in a lid-like manner about a pivot axis 7. The housing top part extends over approximately three-quarters of the length of the housing bottom part, that is to say approximately over the length of a cigarette. The housing top part 6 has, on the underside facing the housing bottom part 1 during pivoting, a longitudinal web 10 which, on its lower edge, has a partially cylindrical concave recess 11 which, when the lid-like housing top part 6 is "folded shut", enters a corresponding elongate recess 9 of the cover part 3 of the housing bottom part; The press chamber, designated as a whole by 8, is formed in the recess 9, which press chamber, according to FIG. 3, is limited upward by the part-cylindrical recess 11 of the housing top part 6 and downward by a semi-cylindrically bowl-shaped tongue 12. The recess 11 and the tongue 12 together limit the approximately cylindrical press chamber 8, the diameter and length of which correspond approximately to a cigarette.

That end of the press chamber 8 at the top in FIG. 3 is formed by an abutment 13 perpendicular to the axis of the press chamber 8 and formed on a slide 20 (FIG. 5) which is guided in the housing bottom part 1 on a straight guide extending parallel to the axis of the press chamber 8 and which can be displaced forward on a handle 14 according to FIGS. 1, 3 and 4, as is evident from FIG. 4. The tongue 12 and the abutment 13 are taken up during this movement.

The wall 15 at the end of the press chamber 8 facing away from the abutment 13 in the position according to FIG. 3 has a perforation in the axial direction, the diameter of which corresponds approximately to that of a cigarette and which is surrounded by a nozzle 16 connected to the cover part 3. The nozzle 16 projects from the front side of the wall 15 and is exposed all-round, so that a finished cigarette tube 17 can be pushed onto the nozzle 16 in the manner indicated by dot-and-dash lines in FIG. 3.

Mounted above the nozzle 16 in the cover part 3 is an elastomeric body 18 which is freely accessible from above and which, in the relieved state reproduced in FIG. 3, provides with its underside a small clearance relative to the top side of the nozzle 16, so that pushing the cigarette tube 17 in is not impeded.

Provided on the underside of the housing top part 6 is a projection 19 which, when the housing top part 6 is folded shut, exactly meets the elastomeric body 18 and deforms the latter in the way evident from FIG. 2, with the result that the latter comes into place with its underside firmly on that end of the cigarette tube 17 supported by the nozzle 16 and clamps the cigarette tube 17 against forces which endeavor to pull the cigarette tube 17 off from the nozzle 16.

The initial position for producing a cigarette is reproduced in FIG. 3. The housing top part 6 is folded open. The press chamber 8 is accessible from above. Loose tobacco is now introduced into the press chamber 8 as evenly as possible in a quantity sufficient for a cigarette. The cigarette tube 17 is slipped onto the nozzle 16. The housing top part 6 is then pivoted downward and the loose tobacco is pressed by the web 10 to form an approximately cylindrical strand which rests on the tongue 12. With the housing top part closed the molding or elastomeric body 18 retains the cigarette tube 17 on the nozzle 16.

The tongue 12 is now pushed forward according to FIG. 4 by means of the handle 14, with the tongue 12 passing through the nozzle 16 into the cigarette tube and taking up the tobacco strand which is pushed by the abutment 13. In the position shown in FIG. 4, the tobacco strand in transferred completely into the cigarette tube 17.

The handle 14 is then returned again into the rear position reproduced in FIGS. 1 and 3, the tongue 12 being drawn out of the cigarette tube 17 and the tobacco strand remaining in the cigarette tube 17 on account of the greater friction on the paper of the latter. The housing top part can then be released, with the result that the elastomeric molding 18 is relieved and the cigarette tube 17, filled with tobacco, can be pulled off from the nozzle 16.

The design of the cigarette tube filling machine 100 on the inside is shown in FIGS. 5 to 8. It is evident from the cross section of FIG. 5 that the tongue 12 together with the abutment 13 is attached to a slide, designated as a whole by 20, from which an extension 21 approximately parallel to the base surface 4 of the base part 2 and located in the region of the interface between the base part 2 and the cover part 3 extends outward through a lateral slot 22 of the housing bottom part. The handle 14 sits on the extension 21 just outside the housing bottom part 1 and has a part 23 which extends approximately over the height of the housing bottom part plus the housing top part 6 and which has at the top, just above the housing top part 6, an angling portion 24 partially engaging over the housing top part 6 and, at the bottom, an equidirectional angling portion 25 which engages a corresponding recess 26 of the base part 3 and which has its underside aligned with the base surface. The handle 14 can thereby be grasped with two fingers simultaneously from above and below, so that the grasping forces do not load the guide of the slide.

The slide 20 extends between the press chamber 8 and the handle 14. The straight guide for the slide 20 comprises a guide web 27 which projects upward from the bottom of the trough-shaped or bowl-shaped base part 2, narrows slightly upward and is parallel to the press chamber 8 corresponding to the cigarette and therefore to the advance of the slide 20. Guide web 27, according to FIG. 5, engages a corresponding recess 28 of the slide 20 from below, which recess 28 surrounds the web 27 with only a slight amount of play, but still in an easily slidable manner.

A web 29 running approximately parallel to the bottom of the base part 2 extends from the slide 20 toward the press chamber 8, which web 29 is angled upward in the region of the press chamber 8 and is connected to the underside of the tongue 12 at a point located outside its center on the side of the slide 20. The tongue 12 is therefore kept completely free by the straight guide web 27 and recess 28 from tilting moments exerted by the handle 14.

Figure 5:
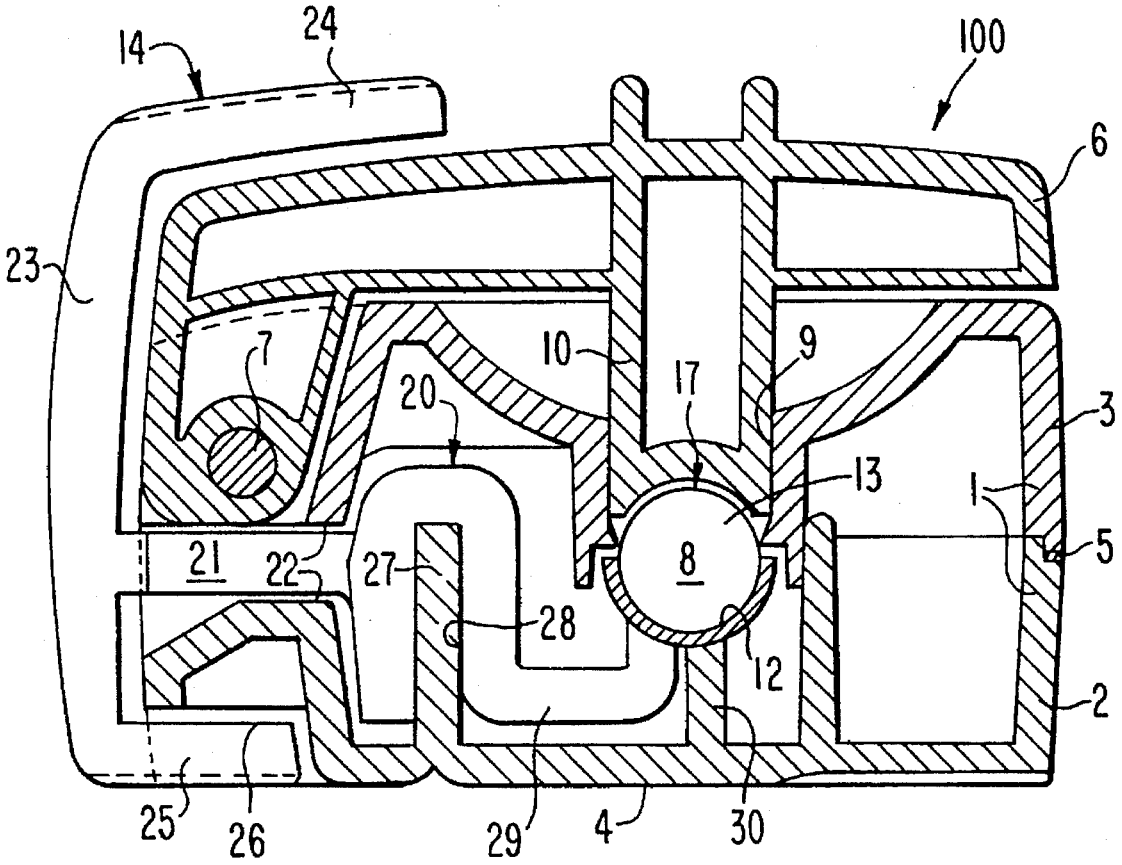
FIG. 5 shows a cross section approximately along the line IV—IV in FIG. 1.

When tobacco is located in the press chamber 8 and is compressed during the downward pivoting of the housing top part 6, according to FIG. 5, the tongue 12 experiences downward-directed forces, against which it is supported as a result of the hearing of its lower region on a supporting web 30 projecting from the bottom of the base part 2 and extending parallel to the press chamber 8.

Figure 6:
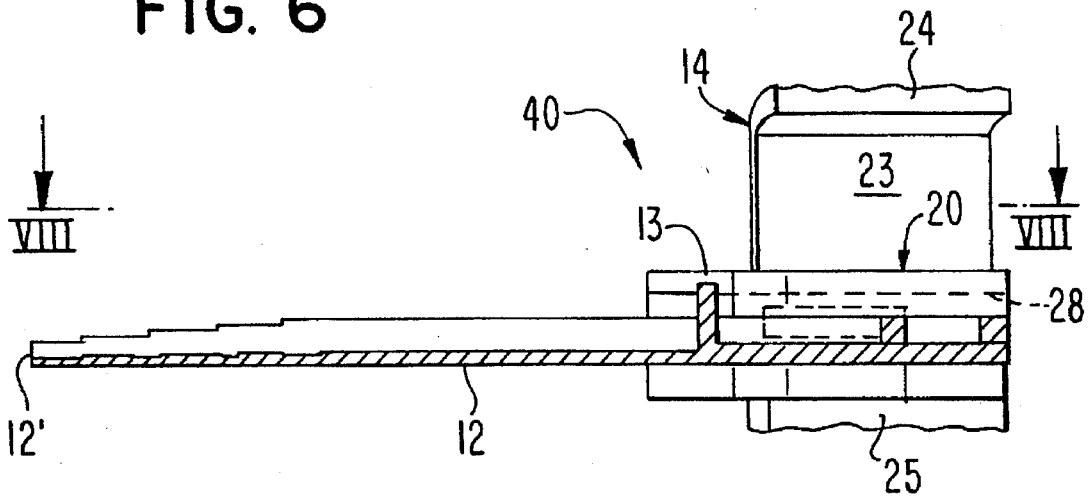
FIG. 6 shows a side view of the component comprising the tongue, the slide and the extension together with the handle, in section along the line VI—VI in FIG. 8.
Figure 7:
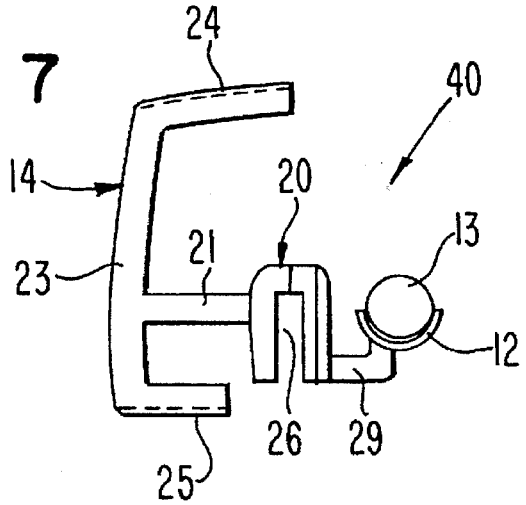
FIG. 7 shows a view according to FIG. 6 from the left.
Figure 8:
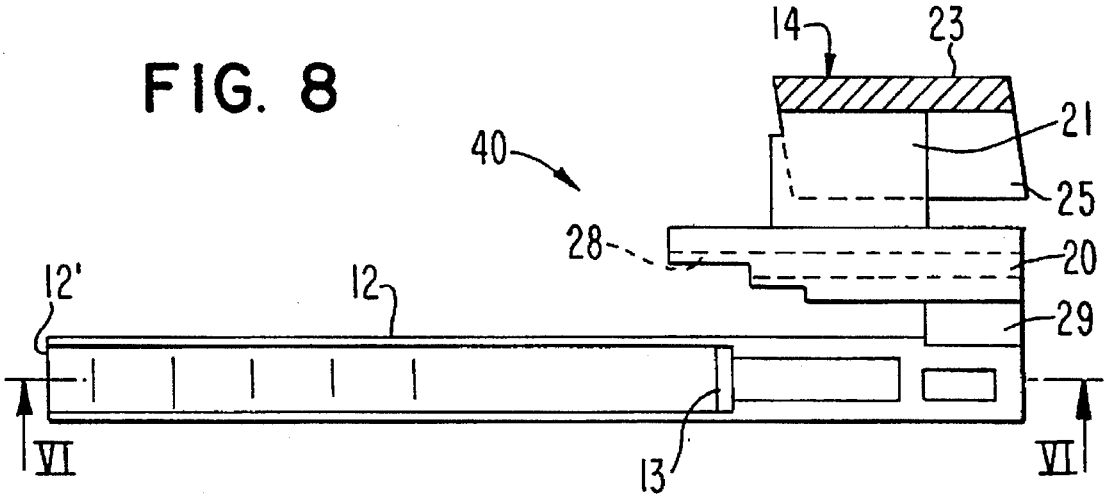
FIG. 8 shows a view according to FIG. 6 from above in section along the line VIII—VIII.

The tongue 12, slide 20, extension 21 and handle 14 form a unitary component 40 which is represented in FIGS. 6 to 8. This component, like the remaining parts of the cigarette tube filling device 100, can be injection-molded from plastic. The length of the tongue 12 from the left-hand end 12' as far as the abutment 13 corresponds to the length of the tobacco strand in the cigarette. The length of the handle 14, especially of the upper part 24, is selected in such a way that it covers that rear part of the housing bottom part 1 which is free of the housing top part 6, as is evident from FIGS. 1 and 3, so that, in this position of the handle 14, the housing top part 6 can be swung upward. The height of the handle 6 above the cover part 3 is selected in such a way that the part 24 of the handle can he guided over the housing top part 6 with a slight clearance, as is evident from FIGS. 4 and 5. Provided on the top side of the cover part 3, in the vicinity of the overhanging edge of the part 24 of the handle 14, is a web 31 which covers the gap between the part 24 and the top side of the cover part 3, so that no foreign bodies can infiltrate between them in the transport position reproduced in FIG. 1.

The assembly of the cigarette tube filling device 100 is particularly simple. It is necessary merely to attach the housing top part 6 pivotably to the cover part 3. The component of FIG. 6 to 8, designated as a whole by 40, is inserted into the base part 2 of the housing bottom part. The cover part is then placed on top and fastened by snapping it in. The straight guide web 27 and recess 28 consequently can be activated without the parts being capable of coming loose from one another again and without detachable housing parts having to be present, for example on the end faces. A housing design essentially closed all-round and protected against the penetration of dirt is obtained.

We claim:

1. A cigarette tube filling device comprising:

a housing bottom part including an approximately semicylindrical lower half of a press chamber, said press chamber having a length;

a housing top part including an approximately semicylindrical upper half of said press chamber;

said housing top part having an opened position for allowing receipt of tobacco into said lower half of said press chamber and pivoting to a closed position about a pivot axis parallel to an axis of said press chamber;

a nozzle at one end of said press chamber and concentric to said press chamber, said nozzle having a diameter approximately equal to a diameter of said press chamber;

a device for clamping a cigarette tube on said nozzle when said housing top part is pivoted to said closed position; and a unitary component comprising a flute-shaped tongue extending in said housing bottom part along a substantial part of said length of said press chamber and receiving said tobacco;

a slide at an end of said press chamber opposite said nozzle, forming an abutment for an end of a shaped tobacco article, and being displaceable along said press chamber; and an extension extending through a lateral slot of said housing bottom part and having a handle arranged outside said housing bottom part for displacing said unitary component along said press chamber;

wherein said housing bottom part is subdivided at a separating plane and comprises a trough-shaped base part and a cover part;

a linear guide projection protrudes from one of said base part and said cover part parallel to said press chamber and engages said slide of said unitary component; and when said base part and cover part are separated, said unitary component can be inserted into said housing bottom part transversely to said separating plane.

2. A cigarette tube filling device according to claim 1, wherein said guide projection is formed in said base part.

3. A cigarette tube filling device according to claim 2, wherein said guide projection comprises a guide web projecting upward from said base part and extending parallel to said press chamber; and said slide includes a guide groove, complimentary to said guide web and formed to closely surround said guide web.

4. A cigarette tube filling device according to claim 3, wherein said guide web projects parallel to said press chamber and adjacent said extension.

5. A cigarette tube filling device according to claim 1, wherein said device further comprises snap connection means for joining said base part and said cover part.

6. A cigarette tube filling device according to claim 1, wherein a supporting web extends from said bottom of said base part over a portion of said length of said press chamber and engages an underside of said tongue.

7. A cigarette tube filling device according to claim 1, wherein said handle extends adjacent said housing over a height of said housing and can be grasped between two fingers.

* * * * *